United States Patent [19]

Moscovich

[11] 4,385,763

[45] May 31, 1983

[54] PATTERN FORMING BALL GAME

[76] Inventor: Ivan Moscovich, 19 Elkachi Str., Afeka-Ramat Aviv, Israel

[21] Appl. No.: 275,017

[22] Filed: Jun. 18, 1981

[51] Int. Cl.[3] ..... A63F 3/00; A63B 67/14

[52] U.S. Cl. ..... 273/86 R; 273/123 R; 273/153 S; 273/271; 273/144 B; 273/340

[58] Field of Search ..... 273/115, 118 R, 284, 273/287, 340, 243, 282, 123 R, 153 S, 86 R

[56] References Cited

U.S. PATENT DOCUMENTS

| | | | |
|---|---|---|---|
| 1,561,881 | 11/1925 | Osterberg | 273/115 X |
| 1,567,966 | 12/1925 | McKenzie | 273/115 |
| 1,683,860 | 9/1928 | Cahill | 273/260 |
| 3,113,778 | 12/1963 | Silverman | 273/284 |
| 3,860,242 | 1/1975 | Martin | 273/243 |
| 3,946,514 | 3/1976 | Joslyn | 434/96 X |
| 3,984,107 | 11/1976 | Nelson | 273/284 X |
| 3,994,498 | 11/1976 | Breslow et al. | 273/340 |
| 4,118,035 | 11/1978 | Row | 273/243 |
| 4,248,429 | 2/1981 | Mazuela | 273/123 R |
| 4,317,515 | 2/1982 | Feeley et al. | 273/315 R |

*Primary Examiner*—Richard C. Pinkham
*Assistant Examiner*—Scott L. Brown
*Attorney, Agent, or Firm*—Benjamin J. Barish

[57] ABSTRACT

A game comprises a closed container having a transparent top wall and a bottom wall formed with a number of holes therethrough, there being a plurality of differently-colored balls disposed within the container and manipulatable by the player's finger tips to seat in different holes in the container bottom wall and thereby to form different patterns of balls viewable through the transparent top wall of the container.

9 Claims, 8 Drawing Figures

PATTERN FORMING BALL GAME

BACKGROUND OF THE INVENTION

The present invention relates to a game, and particularly to a game in which the player or players move a plurality of balls within a container to form different patterns.

An object of the present invention is to provide a game of the foregoing type which is directed particularly to the development of manual skills, dexterity and visual perception in the movement of a plurality of balls within a closed container to form different patterns of balls therein.

SUMMARY OF THE INVENTION

According to the invention, there is provided a game including a closed container having a transparent top wall and a bottom wall formed with a number of holes therethrough. The game further includes a plurality of balls disposed within the container so as to be freely movable therein. The number of balls within the container is less than the number of holes through the container bottom wall, and the diameter of the balls is larger than the size of the holes through the container bottom wall. The arrangement is such as to permit a player to manipulate the balls externally of the container by the use of his finger tips. Thus, the player presses his finger tips, of one or both his hands, through the holes to move the balls and to seat them over different holes in the container bottom wall, thereby to form different patterns of balls within the container viewable through its transparent top wall.

The game can be constructed according to a number of variations, some of which are described herein.

According to one variation, the bottom wall is formed with a rectangular matrix of holes arrayed according to a plurality of horizontal rows and vertical columns. In this construction, there are at least 20 holes in the container bottom wall, and at least 12 balls within the container manipulatable by the player's finger tips to seat over different holes. The described embodiment of the invention with respect to this variation provides 25 holes in the container bottom wall and 16 balls within the container.

The game may also include a pack of display cards illustrating different patterns of balls which the player is to duplicate by manipulating the balls within the container. The player may play the game in solitaire fashion, by picking up a card and attempting to duplicate the pattern of balls as quickly as possible, or the game may be played in a competitive fashion against another player, in which case the game would include a second container having the same construction including the same number of balls, the idea being to be the first to duplicate the pattern displayed on the card.

According to a further variation, the container may be of a non-rectangular configuration simulating the outer shape of an animal, robot, or other toy.

Further features of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
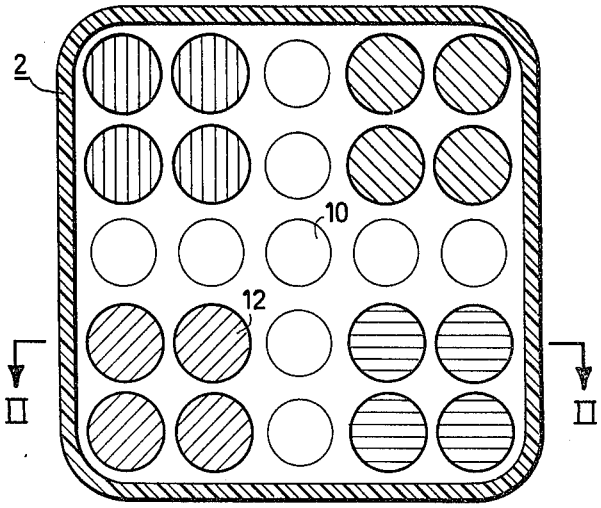
FIG. 1 is a top plan view illustrating one form of game constructed in accordance with the invention.
Figure 2:
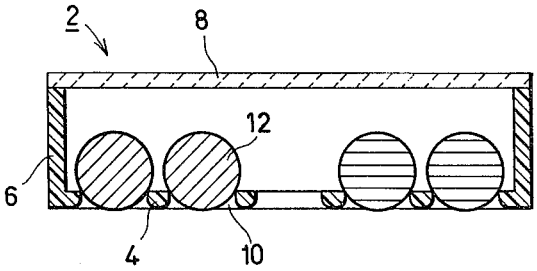
FIG. 2 is a transverse sectional view along lines II—II of FIG. 1.

With reference to FIGS. 1 and 2 of the drawings, the game illustrated therein comprises a container, generally designated 2, including a bottom wall 4, a side wall 6, and a top wall 8, all made of suitable plastic material. The top wall 8 is transparent to enable the interior of the container to be viewed therethrough, whereas the bottom wall 4 and side wall 6 are preferably of suitably-colored opaque material.

The bottom wall 4 is formed with a plurality of holes 10 therethrough. There should be a substantial number of closely-spaced holes, the example illustrated in FIGS. 1 and 2 having 25 of such holes 10 arranged in a 5×5 matrix of 5 horizontal rows and 5 vertical columns.

A plurality of balls 12 are disposed within container 2 for free movement therein. The balls 12 are all of equal diameter, which is larger than the diameter of the holes 10, so that each ball can stably sit over one of the holes with the outer face of the bottom of a ball seated within a hole substantially flush with the outer face of the container bottom wall 4, as shown particularly in FIG. 2. As also shown in that figure, the inner face of the bottom wall 4 is flat and uninterrupted except for the holes 10. There should be a significant number of balls 12 within the container 2, for example, at least 12 (16 being illustrated in the FIG. 1 25-hole container), which number should be less than the number of holes to enable the balls to be manipulated to different holes. In addition, the balls are differently colored, e.g., in the illustrated example there are four colors, there being four balls of each color.

The construction of device illustrated in FIGS. 1 and 2 is such that the player may manipulate the balls 12 externally of the container by applying his finger tips through the holes 10 in the container bottom wall 4 to unseat the balls from their respective holes 10 and to roll them to different holes. The player may thus form a great number of different patterns in this manner, both abstract and figurative patterns, different in form as well as in color.

By providing 16 balls 12 within the container, the player may use his 8 fingers of both hands for manipulating the balls to produce the desired pattern.

Figure 3:
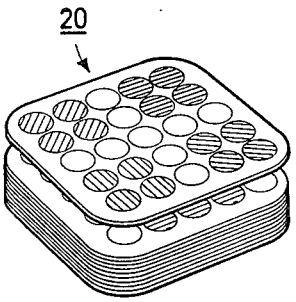
FIG. 3 illustrates a stack of cards that may be used in the game.
Figure 3A:
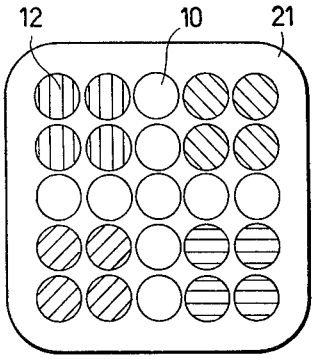
FIGS. 3*a*, 3*b*, and 3*c* illustrate different cards in the stack of FIG. 3 and displaying different patterns to be reproduced by the players by manipulating the balls within the container.
Figure 3B:
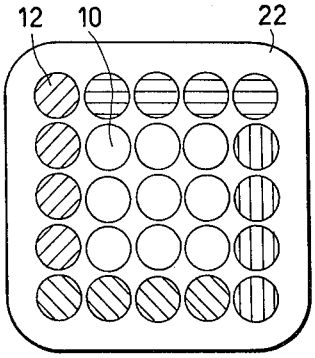
Figure 3C:
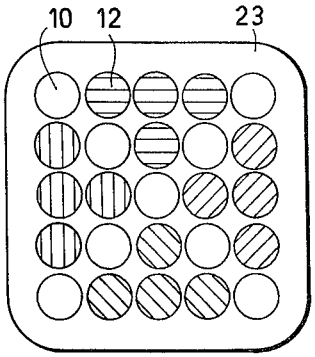

The game may also include a set of display cards, generally designated as 20 in FIG. 3, illustrating different patterns of balls which the player is to duplicate by manipulating the balls within the container. FIGS. 3*a*, 3*b* and 3*c* illustrate three of such cards, therein designated 21, 22 and 23, respectively, displaying three typical patterns that the player is to duplicate.

Instead of using the set of cards 20 to provide the different patterns of balls 12, the game may include a second container, identical to container 2, and also including the same number of balls 12 as described above.

The second container could serve as the means for providing the model pattern to be duplicated, in which case one of the players in his turn shakes the balls within the second container to produce an arbitrary or fanciful array of balls 12 on the holes 10. In this manner, a large number of different random patterns may be created which would have to be reproduced by the player.

The reproduction of each pattern, either according to a selected card of the set of cards 20, or according to the random pattern produced by shaking a second container, may be done either in a solitaire manner or in a competitive manner. If done in a competitive manner, one player would be competing against another to reproduce the pattern first, and therefore there would be a separate container 2 for each player.

Figure 4:
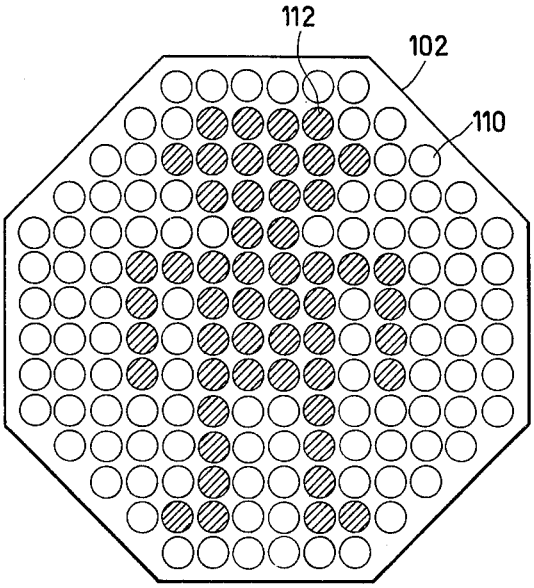
FIGS. 4 and 5 illustrate other configurations of containers that may be used.

FIG. 4 illustrates a somewhat more elaborate construction wherein the container, therein generally designated 102, is provided with a much larger number of holes through its bottom wall than container 2 in FIG. 1. In the construction illustrated in FIG. 4, there are 156 holes also arranged in a matrix consituted of a plurality of horizontal rows and a plurality of vertical columns, except that the outer periphery of the container is not square or rectangular, as in FIG. 1, but rather is octagonal. In addition, the container of FIG. 4 includes 50 balls 112 movable to different ones of the holes 110, in the manner described above with respect to FIG. 1, for producing different patterns.

Figure 5:
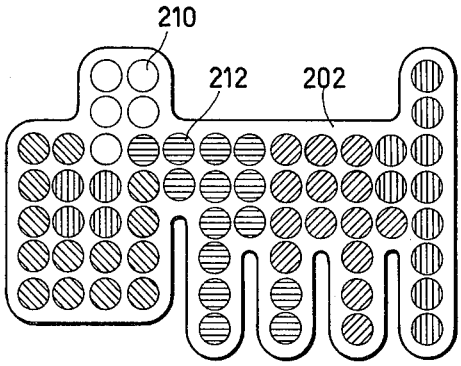

FIG. 5 illustrates a still further variation wherein the container, therein generally designated 202, is of a configuration simulating the outer shape of an animal (such as a dog), or other toy. The balls 212 included within the container 202 of FIG. 5 would also be of different colors, so that by manipulating them to move them to different ones of the holes 210 through the bottom wall of the container, different patterns can be created.

While the invention has been described with respect to several preferred embodiments, it will be appreciated that many variations, modifications and applications of the invention may be made. Thus, the game could be in the form of a puzzle including "n" (e.g., 20) holes and "n−1" (e.g., 19) balls of different colors, the idea being to manipulate the balls in the above-described manner, by providing only one vacant hole, until all the same-colored balls are lined-up. The device can be easily "scrambled" at the beginning of each new game by merely shaking.

Many other variations, modifications and applications of the invention will be apparent.

What is claimed is:

1. A game including a closed container having a top transparent wall and a bottom wall formed with a number of holes therethrough, and a plurality of balls disposed within said container and freely rollable therein, the number of balls within the container being less than the number of holes through the container bottom wall, and the diameter of said balls being larger than the size of said holes, such that the outer face of the bottom of a ball seated within a hole is substantially flush with the outer face of said bottom wall, the inner face of said bottom wall being flat and uninterrupted except for said holes, whereby a player may manipulate the balls externally of the container with his finger tips to roll the balls over the container bottom wall so as to seat in different holes in the container bottom wall and thereby to form different patterns of balls therein viewable through the transparent top wall of the container.

2. The game according to claim 1, wherein said holes through the container flat bottom wall are arrayed according to a rectangular matrix constituted of a plurality of horizontal rows and a plurality of vertical columns.

3. The game according to claim 1, wherein there are at least 20 holes through the container flat bottom wall, and at least 12 balls within the container rollable by the player's finger tips to seat in different holes.

4. The game according to claim 3, wherein said balls are of a plurality of different colors.

5. The game according to claim 1, further including a set of display cards illustrating different patterns of balls which the player is to duplicate by manipulating the balls within the container.

6. The game according to claim 5, further including a second container of the same construction and containing the same plurality of balls as in the first-mentioned container, which second container is for use by a second player.

7. The game according to claim 1, wherein the container is of rectangular configuration.

8. The game according to claim 1, wherein the container bottom wall is formed with a matrix of at least 100 holes, and the container includes at least 35 balls disposed therein.

9. The game according to claim 1, wherein the container is of a non-rectangular configuration simulating the outer shape of a toy.

* * * * *